United States Patent [19]

Kondo et al.

[11] 4,299,112

[45] Nov. 10, 1981

[54] METHOD AND DEVICE FOR PRODUCING SYNCHRONIZER RING

[75] Inventors: Kazuyoshi Kondo, Okazaki; Yoshiaki Nakamura, Tsu, both of Japan

[73] Assignee: Kabushiki Kaisha Wako, Tokyo, Japan

[21] Appl. No.: 950,979

[22] Filed: Oct. 13, 1978

Related U.S. Application Data

[62] Division of Ser. No. 843,886, Oct. 20, 1977.

[51] Int. Cl.[3] ..... B21D 45/02

[52] U.S. Cl. ..... 72/354; 72/344; 72/352; 72/358; 29/159.2

[58] Field of Search ..... 72/344, 345, 353, 354, 72/358, 359, 360, 356, 327, 264, 267; 29/159.2

[56] References Cited

U.S. PATENT DOCUMENTS

| | | | |
|---|---|---|---|
| 2,726,560 | 12/1955 | Roux | 72/345 |
| 3,048,063 | 8/1962 | Chatfield | 72/345 |
| 3,149,416 | 9/1964 | Moore | 72/356 |
| 3,370,450 | 2/1968 | Scheucher | 72/354 |
| 3,535,762 | 10/1970 | Taylor | 29/159.2 |
| 3,675,459 | 7/1972 | Dohmann | 29/159.2 UX |
| 3,731,516 | 5/1973 | Dohmann et al. | 72/354 |
| 3,832,763 | 9/1974 | Schober | 29/159.2 |
| 3,842,646 | 10/1974 | Kuhn | 29/159.2 X |

FOREIGN PATENT DOCUMENTS

| | | | |
|---|---|---|---|
| 2224913 | 11/1973 | Fed. Rep. of Germany | 72/356 |
| 53-8539 | 3/1978 | Japan | 72/354 |
| 12137 | of 1885 | United Kingdom | 72/354 |
| 21334 | of 1907 | United Kingdom | 72/353 |
| 407618 | 4/1974 | U.S.S.R. | 72/353 |
| 539648 | 1/1977 | U.S.S.R. | 72/344 |

OTHER PUBLICATIONS

A.P.C. 191,168 Singer published Apr. 27, 1943.

*Primary Examiner*—Lowell A. Larson
*Attorney, Agent, or Firm*—Fitzpatrick, Cella, Harper & Scinto

[57] ABSTRACT

A planar blank material to be press-formed is confined in a space formed by punch means having peripheral flange part provided with gear teeth corresponding to those of the hollow product, a mandrel provided slidably in the central hole of said punch means and having outer diameter corresponding to the inner diameter of the hollow product, and a die means having bottom surface and through hole having inner contour corresponding to the outer contour of the boss part of the product. By the pressing action, the peripheral flange part having teeth of the product is formed and simultaneously boss part of the product is formed whereby the synchronizer ring product is formed by one step and the blank material corresponding to the through hole of the product and the product are both ejected out by returning the punch means, mandrel, and die means.

2 Claims, 10 Drawing Figures

FIG. 2(III)
PRIOR ART
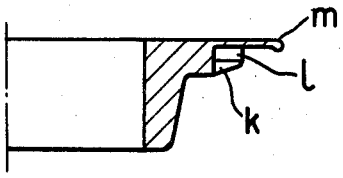

FIG. 3(III)
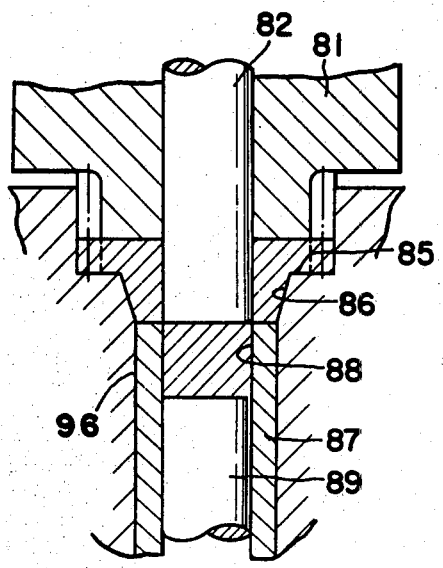

METHOD AND DEVICE FOR PRODUCING SYNCHRONIZER RING

This is a divisional of application Ser. No. 843,886, filed Oct. 20, 1977.

BACKGROUND OF THE INVENTION

This invention relates to a method and device for press-forming a hollow article having a flange in one step by utilizing a method of forming materials by plastic deformation.

There is a great variety of hollow articles having flanges at their ends, such as synchronizer rings c (having through hole) as shown in FIG. 1. A conventional method for producing these articles is shown in FIGS. 2(I)–2(IV).

In FIGS. 2(I) through 2(IV), there are indicated steps of conventional production of a synchronizer ring gear c, such as shown in FIG. 1 wherein a material blank j obtained by forging and the like process is subjected to coining on a bevelled and indented surface k thereof, a tooth pattern 1 being thereafter press-formed, and the waste part m is punched off. In addition, the internal hole n and the boss part o must be machined, so that the entire process of the production requiring considerable labor, and, furthermore, the productivity thereof has been extremely low.

SUMMARY OF THE INVENTION

A primary object of the invention is to provide a method and device for producing a synchronizer ring having a through hole and tooth flange part, by punching out the blank material by one step.

Said object of the present invention has been effectively attained by the method for producing a synchronizer ring, which comprises the steps of arranging a punch member and a die member in an opposed and mutually approachable relation, said punch member being provided in the axial hole thereof with a mandrel having an outer diameter equal to the inner diameter of the axial hole of the product and provided at its peripheral part with gear teeth corresponding to the gear teeth of the product, and said die member being provided with a die hole having an inner contour of the gear shape corresponding to the outer contour of the punch member and with a through hole having an inner contour corresponding to the outer contour of the boss part of the product; further arranging slidably in said through hole ejector means for ejecting the press-formed product and the punched-off material, said ejector means being faced the said mandrel; placing a planar blank material between a space formed by said die member and punch member; pressing together the punch member and die member thereby press-forming the flange part and its peripheral gear teeth of the product, press-forming of said flange part causing a flow of the material into said through hole of the die member; simultaneously with said press action, the mandrel is projected from the punch member thereby to form the internal through hole of the product; and then returning the punch member, die member and mandrel to their original position while ejecting a product and the punched-off material.

According to one aspect of the present invention, there is provided a method for producing a hollow article with a flange comprising the steps of:

arranging in a mutually opposed relation a first tool member provided with a through hole having an inner contour corresponding to the outer contour of the hollow main part of the article and second tool member supporting a mandrel having an outer contour corresponding to the inner contour of the internal hole of the hollow article, so that a vertically compressable space to provide an inner contour corresponding to the outer contour of the flange part of the article is formed therebetween;

the first tool member being further provided with a die hole at the end of the through hole remote from the second tool member to operate cooperatively with the mandrel;

inserting in the space a material of a planar shape and of a size equal to or slightly smaller than the inner contour of the space;

pressing the two tool members together so that the flange part of the article is press-formed out of the peripheral part of the material, the press-forming of the peripheral part causing a flow of material into the through hole of the first tool member thereby elevating the surface of the material in the through hole;

projecting simultaneously the mandrel into the space thereby forming the hollow main part of the article in hat shape out of the material; and further projecting the mandrel so that the top of the hat-shaped part is punched between the mandrel and the die hole thereby forming a through hole in the article.

The nature, principle, and the utility of the present invention will be made apparent from the following detailed description of the invention when read in conjunction with the accompanying drawings.

DETAILED DESCRIPTION

A press-forming method constituting a basic process according to the present invention will be first described with reference to FIGS. 3(I) through 3(V).

Figure 1:
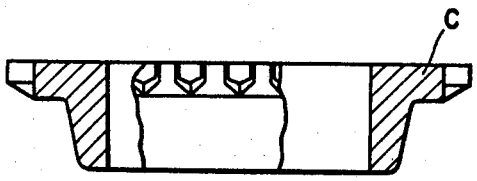
FIG. 1 is a longitudinal sectional view, partly cut away, of a synchronizer ring produced according to the present invention.
Figure 2I:
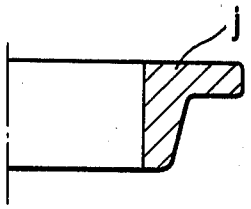
FIG. 2(I) PRIOR ART
FIGS. 2(I), 2(II), 2(III), and 2(IV) are right halves of longitudinal sectional views illustrating conventional process steps in the fabrication of the synchronizer ring shown in FIG. 1.
Figure 2:
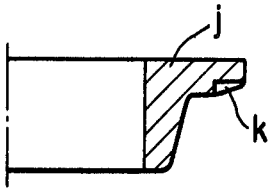
FIG. 2(II) PRIOR ART
Figure 2:
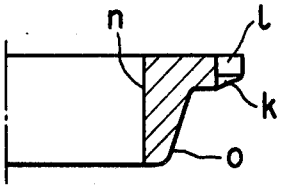
FIG. 2(IV) PRIOR ART
Figure 3I:
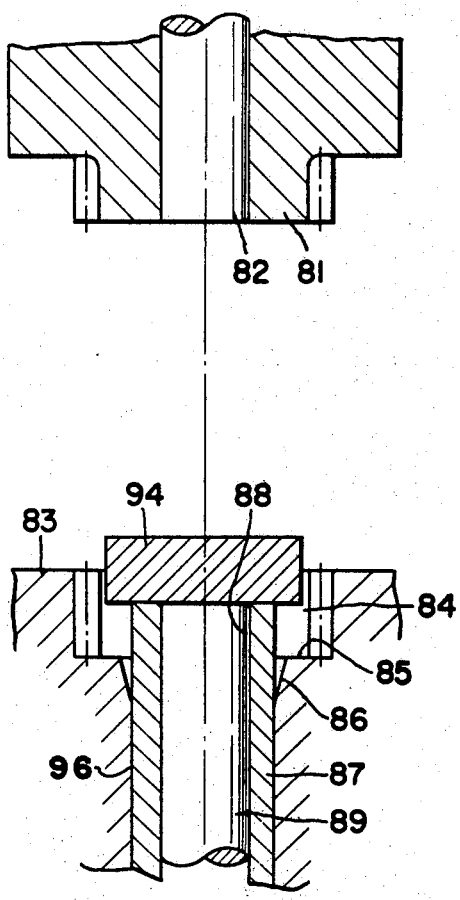
FIGS. 3(I) through 3(IV) are longitudinal sectional views showing various stages of the operation of tools for practicing the invention in fabricating a synchronizer ring.
Figure 3:
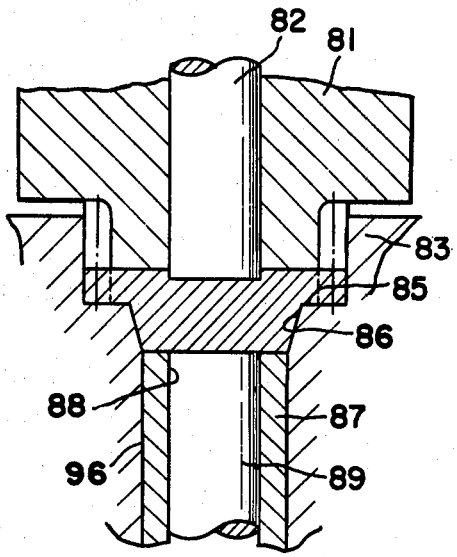
Figure 3:
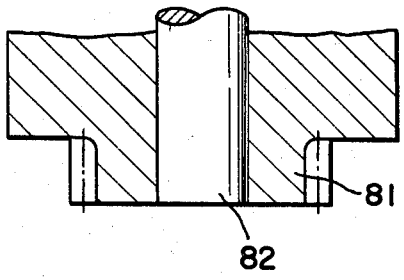
Figure 3V:
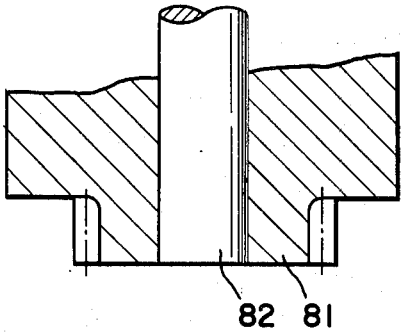
Figure 3V:
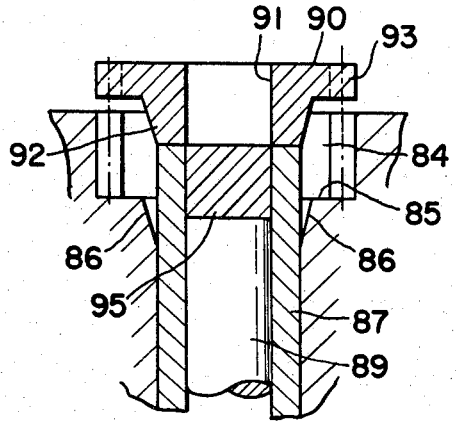
Figure 3V:
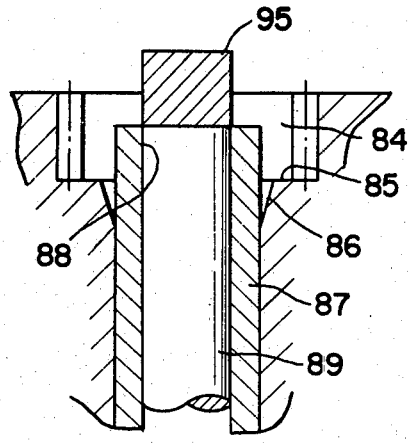

In FIGS. 3(I) through 3(V), another example of the process for producing a synchronizer ring c as shown in FIG. 3 is illustrated.

The outer contour of a punch member 81 conforms to that of the product gear 93, and a mandrel 82 having an outer diameter equal to the inner diameter of the axial hole 91 of the product is held freely slidably through an axial hole provided in the punch member 81. A die member 83 has a die hole 84 having an inner contour of gear shape corresponding to the outer contour of the punch member 81 and also having a bottom surface 85 through which is provided a through hole 86 having an inner contour corresponding to the outer contour of the boss part 92 of the product. The die member 83 is further provided with an axial hole 96 the upper edge of which is continued with the lower edge of the through hole 86, and in the hole 96 there is disposed a hollow ejector 87 having an axial bore 88, the diameter of which corresponds to the outer diameter of mandrel 82 so that the mandrel is freely slidable therein, the upper part of the axial hole 88 constituting another die hole cooperating with the facing end of the mandrel 82. Furthermore, in the axial hole 88 provided in the ejector 87, an auxiliary ejector 89 of a mandrel type is slidably provided.

A material blank 94 formed with an outer diameter equal to or slightly smaller than the diameter of the bottom of the tooth of the product gear is supplied into the die hole 84 as shown in FIG. 3(I).

The subsequent processes are as follows. The punch member 81 is forced into the die member 83, and simultaneously the mandrel 82 is projected. The material blank 94 is squeezed between the punch member 81 and the bottom surface 85 of the die hole 84, so that a part of the material is thereby forced into the tooth-shaped peripheral part of the die member to be formed into the tooth part of the product, while the other part of the material is forced inwardly thereby forming a raised part in the through hole 86 and also a recess in the upper central part of the material. The inward flow of the material is accelerated by the projection of the mandrel 82 until the material fills the interior of the through hole 86 and is formed into the boss part 92 of the product as shown in FIG. 3(II). The top of the boss part 92 is further punched by the succeeding projection of the mandrel 82 into the axial hole 88 of the hollow ejector 87 thereby forming the through hole 91 of the product as shown in FIG. 3(IV). The punch member 81, die member 83, and the mandrel 82 are then returned to their original positions, and the ejector 87 is projected thereby pushing the thus formed product 90 out of the die member 83 as shown in FIG. 3(IV). A piece of scrap 95 produced when the top of the boss part 92 has been punched out is delivered by the projection of the auxiliary ejector 89 as shown in FIG. 3(V) thereby completing all process steps required for this example.

In the above described example, the contour of the tooth part of the product may be formed greater than the normal shape by an allowance, and the thus produced coarse shaped gear may be thereafter finished by utilizing either the opposed dies shearing method or the shaving method or an ordinary machining procedure. Since the allowance in the product can be minimized by the present invention, the product ring gear can be finished with high productivity and high precision.

We claim:

1. A method for producing a hollow synchronizer product having an axial hollow part, a flange part provided with peripheral gear teeth and a boss part: which comprises the steps of clamping a planar blank material between the under surface of a punch member supported slidably for vertical movement and the upper surface of a die member, said punch member being provided with an axial hole having a diameter equal to the inner diameter of the hollow part of the product, with a peripheral part having teeth corresponding to the gear teeth of the product, and with a mandrel slidable in said axial hole, and said die member being provided with a die hole having an inner contour consisting of a peripheral part having teeth corresponding to the gear teeth to be formed in the product's outer surface and a through hole corresponding to the boss part of the product, with another axial hole continued at its upper edge with the lower edge of said through hole, and with ejector means consisting of a hollow ejector and an auxiliary ejector of the mandrel type, said hollow ejector being a hollow cylinder provided with an axial bore having an inner diameter corresponding to outer diameter of the mandrel in the punch member and being slidably inserted into said another axial hole in the die member, the upper part of said axial hole in said hollow ejector forming another die hole cooperating with the mandrel in the punch member when the hollow part of the product is pierced, and said auxiliary ejector being slidably inserted in said axial hole of the hollow ejector; pressing together said punch member and said die member thereby press-forming the flange part and peripheral gear-teeth of the product, the press-forming of said flange part causing a flow of material of said flange part into said through hole of the die member; simultaneously with said pressing, projecting the mandrel of the punch member therefrom thereby to assist said flow of the blank material into said through hole of the die member and then to pierce the product together with the upper part of the axial hole of said hollow ejector so as to dispose a cut piece of scrap into the hollow part of the hollow ejector and thereby to form the internal hollow part, peripheral gear teeth, and boss part of the product; and then returning the punch member, die member, mandrel and ejector means while ejecting a product by the hollow ejector and the cut piece of the scrap by the auxiliary ejector from the die member.

2. A device for producing a hollow synchronizer product having an axial hollow part, a flange part provided with peripheral gear teeth, and a boss part: which comprises, a punch member and a die member arranged in opposed and mutually approachable relation, said punch member being provided with an axial hole having a diameter equal to inner diameter of the hollow part of the product, with a peripheral part having teeth corresponding to the gear teeth of the product, and with a mandrel slidable in said axial hole, and said die member being provided with a die hole having an inner contour consisting of a peripheral part having a tooth-shaped part corresponding to the gear teeth to be formed in the product's outer surface and a through hole corresponding to the outer surface of the boss part of the product, and with another axial hole continued at its upper edge with the lower edge of said through hole; and ejector means provided in said another axial hole of the die member and consisting of a hollow ejector and an auxiliary ejector of mandrel type, said hollow ejector being a hollow cylinder disposed slidably into said another axial hole of the die member and being provided with an axial bore having an inner diameter corresponding to outer diameter of the mandrel in the punch member, the upper part of the axial hole of said hollow ejector forming another die hole cooperating with the facing end of the mandrel in the punch member, and said auxiliary ejector being inserted slidably in the axial hole of said hollow ejector and having an outer diameter corresponding to that of the mandrel in the punch member.

* * * * *